United States Patent [19]

LaRocca

[11] 4,428,218

[45] Jan. 31, 1984

[54] METHOD OF MANUFACTURE AND ASSEMBLY OF EXTRUDED ALUMINUM SALT FOR ROLLER SHUTTER

[76] Inventor: Joseph M. LaRocca, 190 Edgewater Dr., Coral Gables, Fla. 33133

[21] Appl. No.: 324,543

[22] Filed: Nov. 24, 1981

[51] Int. Cl.[3] ..... B21C 23/14

[52] U.S. Cl. ..... 72/256; 52/588; 72/177; 160/235

[58] Field of Search ..... 160/235, 236; 52/588; 29/513, 521; 72/253.1, 254, 256, 177, 467

[56] References Cited

U.S. PATENT DOCUMENTS

| | | | |
|---|---|---|---|
| 1,891,740 | 12/1932 | Westerman | 29/521 |
| 2,569,621 | 10/1951 | Toney | 160/235 |
| 3,110,171 | 11/1963 | De Ridder | 52/588 |
| 4,187,711 | 2/1980 | Lavochkin et al. | 72/253.1 |
| 4,228,841 | 10/1980 | Dixon | 160/235 |

FOREIGN PATENT DOCUMENTS

| | | | |
|---|---|---|---|
| 1434242 | 11/1968 | Fed. Rep. of Germany | 52/588 |
| 2929284 | 2/1981 | Fed. Rep. of Germany | 160/235 |
| 931666 | 7/1963 | United Kingdom | 160/235 |

OTHER PUBLICATIONS

Specification Sheet: Kömmerling PVC Roller Shutters.

*Primary Examiner*—Lowell A. Larson
*Attorney, Agent, or Firm*—Kenyon & Kenyon

[57] ABSTRACT

In a method for extruding an aluminum slat for a roller shutter with an undercut slot extending along one edge of the slat and formed by spaced apart front and rear members extending from the body of the slat, breakage of the part of the extrusion die which forms the slot is prevented by forming the slot in two steps. In the first step, the slat is extruded through a die which forms the front member in a position angled outwardly, so that the portion of the extruding die corresponding to the opening of the undercut slot can be made thick enough to withstand the extruding pressure without breaking. The front member is then bent back by a rolling operation to its desired position relative to the rear member.

5 Claims, 8 Drawing Figures

Fig. 6.
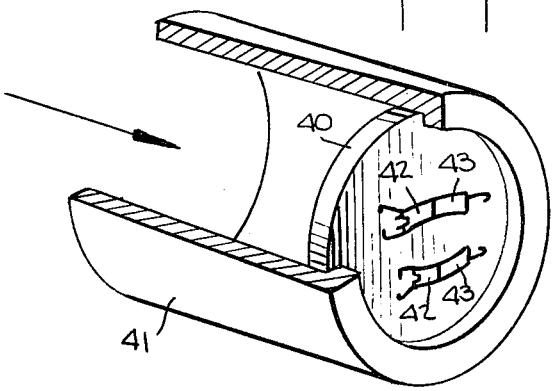
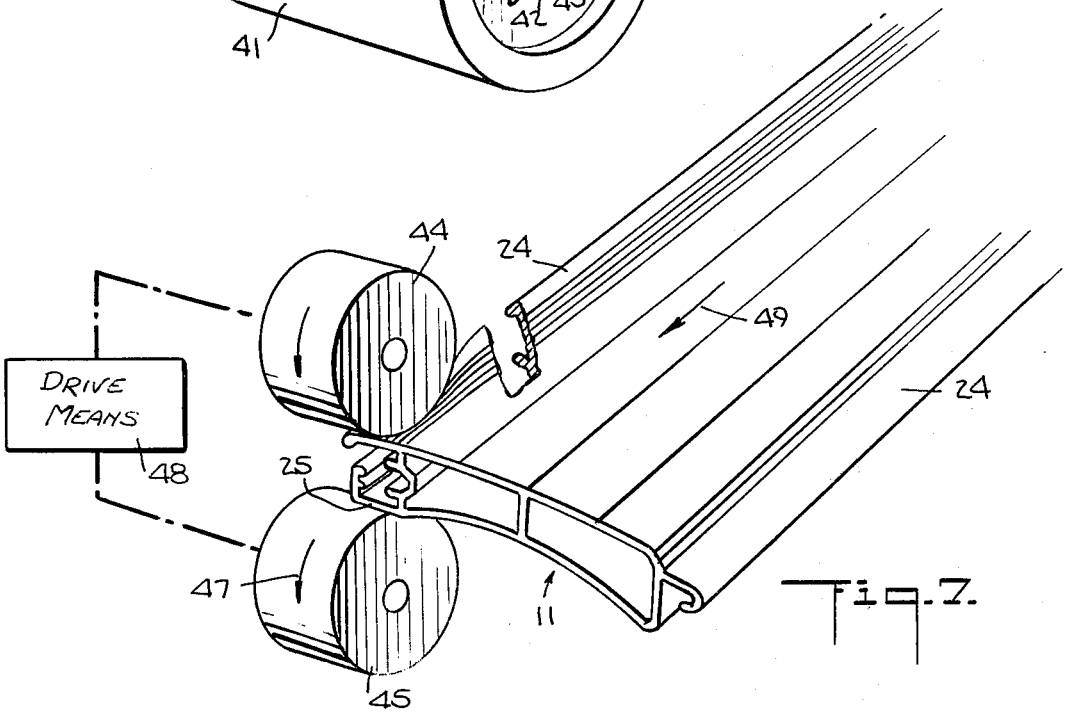
Fig. 7.
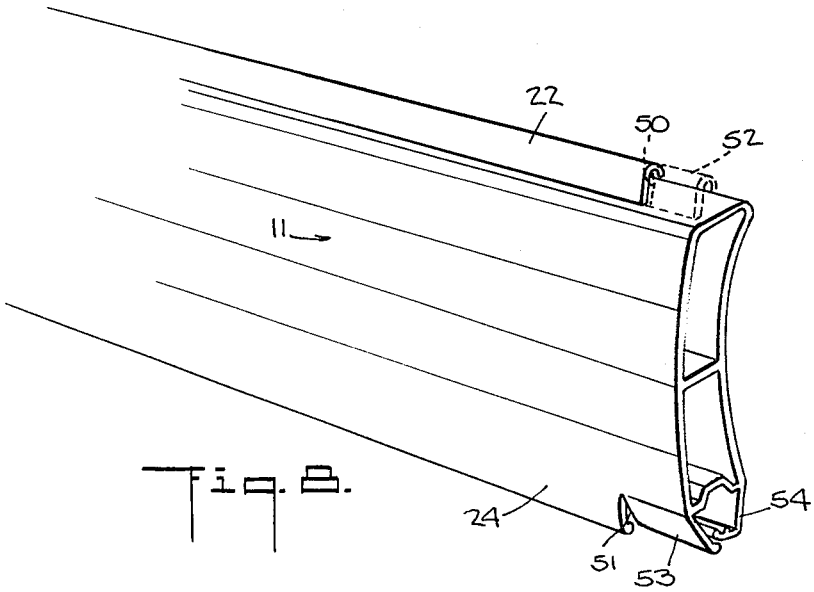
Fig. 8.

METHOD OF MANUFACTURE AND ASSEMBLY OF EXTRUDED ALUMINUM SALT FOR ROLLER SHUTTER

BACKGROUND OF THE INVENTION

1. Field of the Invention

The present invention relates to roller shutters for windows or doors and particularly to a method for manufacturing and assembling slats for such shutters.

2. Description of the Prior Art

Articulated slat roller shutters in which the individual slats are either extruded of plastic resin or rolled from aluminum strip are used in residential and some commercial applications to control light and heat transmission through windows, as well as to provide privacy. The extruded plastic type of shutter requires added steel or aluminum reinforcing ribs if it is to be used for very large windows. The rolled aluminum shutter slats are strong enough for all normal application; however, special rolling dies and machinery are required to form the slats from flat aluminum strip. This equipment is extremely expensive and represents a very high initial investment. It would be desirable, therefore, to be able to extrude such aluminum slats using conventional extrusion presses and a relatively inexpensive die for forming the desired cross-sectional shape of the salt. In addition, extruded aluminum can be easily anodized or painted, whereas rolled strip aluminum cannot be.

To provide an easily assembled articulated joint shutter, the extruded plastic slats (and also the rolled aluminum slats), of the type mentioned above, normally are formed with a curled lip, hook-like in cross section, extending along one edge and an undercut slot extending along the opposite edge. The hooked lip of one slat fits slidably in the undercut slot of an adjacent slat, the opening of the undercut slot being narrow enough to prevent the curled hook portion of the lip from coming out of the slot when the slats are assembled to make a roller shutter.

Because the extrusion die is machined with openings corresponding to the solid parts of the cross section of the extruded slat, and vice-versa, the die will have a solid portion, corresponding to the shape of the interior of the undercut slot, which is joined to the rest of the die only by a thin neck, corresponding to the narrow opening of the slot. This presents no problem at the relatively low pressures used for extruding plastic resin materials. Aluminum extrusion requires much higher pressures, however; so that a die shape designed for extruding a plastic shutter slat cannot be used for extruding aluminum.

As mentioned above, the slats fit slidably together, with the hooked lip of one slat being engaged within the undercut slot of the adjacent slat. To prevent the slats from sliding longitudinally after assembly, which could cause the shutter to jam when being rolled up or down, a friction clip is inserted into each end of each slat as the shutter is assembled. It would be desirable to eliminate the extra cost and time of assembly of these clips, as well as to provide a more secure lock against relative sliding of the slats in the assembled shutter.

SUMMARY OF THE INVENTION

It is an object of the present invention to provide a method of manufacturing an extruded aluminum slat having an undercut slot along one edge while overcoming the problem of extrusion die breakage due to the necessarily narrow opening of the undercut slot.

Another object of the invention is to provide an integral locking arrangement for preventing relative sliding between adjacent slats after assembly of the shutter.

These and other objects are achieved by a method of manufacturing aluminum slats for a roller shutter, and a method of assembling such slats into a shutter, each slat having a first member extending from a first edge and formed, in cross section, with a stem portion and a head portion, the head portion having a greater transverse dimension than the stem portion, and front and rear members extending in spaced apart relation from the opposite edge and forming an undercut slot having an opening wide enough to loosely receive a stem portion of a first member of another slat but too narrow to permit passage of the head portion of such first member, the method of manufacture comprising extruding aluminum through a die conforming to the desired final cross-sectional shape of the slat except that the opening of the die corresponding to the front member is angled away from the opening of the die corresponding to the rear member, so that the front member is extruded in spread apart relation to the rear member, thereby permitting the part of the die corresponding to the opening of the undercut slot to be strong enough to withstand the aluminum extruding pressure; and then bending the front member toward the rear member after the extruding step to obtain the desired final opening dimension between the front and rear members.

The first member preferably is formed as a curled lip; so that it has a hook shape in cross section, the curl of the hook facing the rear of the slat. The rear member extending from the opposite edge preferably is likewise formed with a hook-like shape, allowing interlocking engagement between the first member of one slat and the rear member of another slat. The front member preferably is formed as a plain flap or lip which, in its extruded form is bent forward at a substantial angle, preferably about 30°, from its desired final position. Desirably the thickness of the front member is slightly reduced where the member joins the body of the slat, to provide a natural hinge line. The bending step then is performed on the front member, which in the preferred arrangement serves merely to maintain the other members interlocked and carries no significant stress under operating conditions of the shutter.

The extruding and bending operations are carried out on the aluminum in its soft state, as is conventional. The slat in its final form can then be heat treated to desired strength and hardness and its exterior surface protected by anodizing or other surface coating.

The invention further includes a method of assembling the slats to form a roll down shutter, the method comprising cutting individual slats of the desired length from an extrusion; cutting transverse slots spaced slightly from each end of each slat through the head and stem portions of the first member and through the front and rear members, the portions of the first member and of the front and rear members between each slot and the respective end of the slat thereby forming tabs; removing the first member tabs from each end of each slat; sliding the first member of one slat into the undercut slot of another slat until the ends of the two slats are in alignment; and crimping together the front and rear member tabs at each end of the other slat, thereby locking the first member of the one slat into the undercut slot of the other slat.

The aspects, features, and advantages of the invention will be more fully described in connection with the preferred embodiment, as illustrated in the attached drawings.

BRIEF DESCRIPTION OF THE DRAWINGS

FIG. 6 is a partially cut away perspective view, in semi-schematic form, of an extrusion die arrangement in a conventional extrusion press.

FIG. 7 is a perspective view, in semi-schematic form of a roller arrangement for bending the front member of a slat extruded from the die of FIG. 6.

FIG. 8 is a perspective view of one end of part of a shutter assembly.

DETAILED DESCRIPTION OF THE PREFERRED EMBODIMENT

Figure 1:
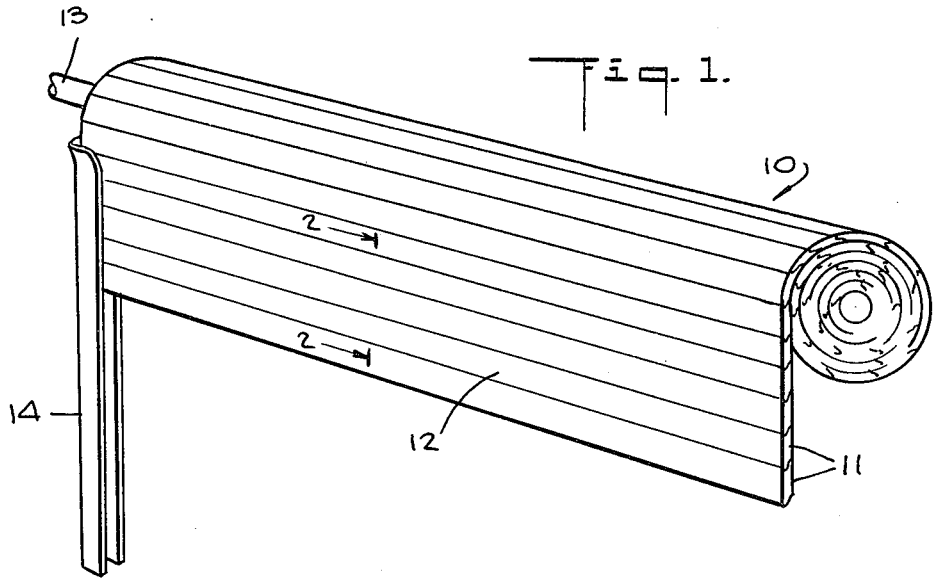
FIG. 1 is a partial, semi-schematic perspective view of a roller shutter incorporating the extruded aluminum slats of the invention.

Referring to FIG. 1, a roller shutter 10 is made up of a number of extruded aluminum slats 11 which are slidingly interlocked to form an articulated screen 12 which can be rolled up on a rotatable shaft 13, mounted on bearing means (not shown) or rolled down into vertical guide channels 14 (only one shown). The general construction of the roller screen is conventional; the present invention relates to the individual slats and the method of manufacturing and assemblying them.

Figure 2:
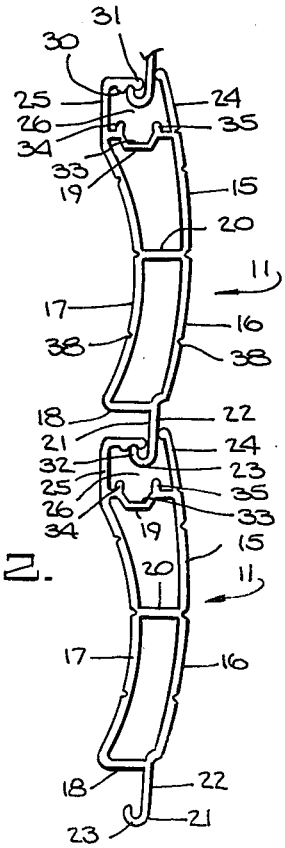
FIG. 2 is a cross section of two interlocked slats of the shutter taken in the direction of arrows 2—2 of FIG. 1.

FIG. 2 shows in detail the cross-sectional shape of each slat and the manner in which adjacent slats are interlocked to provide an articulated connection between them. Each slat 11 has a hollow body portion 15 which includes a front wall 16, a rear wall 17, a first edge wall 18, a second edge wall 19, and an intermediate transverse partition 20. A first member in the form of a curled lip 21, having a hook shape in cross section with a stem portion 22 and a head portion 23, extends from the first edge wall 18. A front member 24 and a rear member 25 extend from the second edge wall 19 to form an undercut slot 26. Although FIG. 2 shows the slats arranged with the slotted edge up and the hooked edge down, the more usual arrangement is just the reverse.

Figure 5:
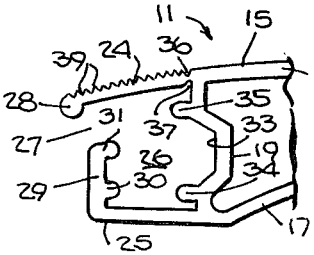
FIG. 5 is a view of the slotted edge portion of the slat corresponding to the view of FIG. 4 but showing the slat after the bending step.

As shown more clearly in FIG. 5, the undercut slot 26 has a narrow opening 27 formed between the free end 28 of the front member 24 and a transverse hook-like lip 29 forming the free end of rear member 25. It can be seen from FIG. 2 that opening 27 is wide enough to loosely accommodate the stem portion 22 of the first member 21 but is too narrow to permit passage of the head portion 23 out of the slot.

The hooked lip portion 29 of rear member 25 is provided with beads or ribs 30 and 31 to help locate the tip 32 of the head portion 23 of the corresponding first member 21 when the shutter is hanging in tension, as in FIGS. 1 and 2. Edge wall 19 is formed with a channel-like portion 33 flanked by beads or ribs 34 and 35 to help center the rounded head portion 23 when the shutter is compressed in its closed position (not shown).

As stated above, each aluminum slat is formed by extrusion. However, if the extruding die has the shape of the finished slat (FIG. 5), the part of the die corresponding to the shape of the interior of the slot 26 will be connected to the rest of the die only by a thin neck corresponding to the opening 27. Because of the high pressure required to extrude aluminum, the die would fracture at this thin neck.

Figure 3:
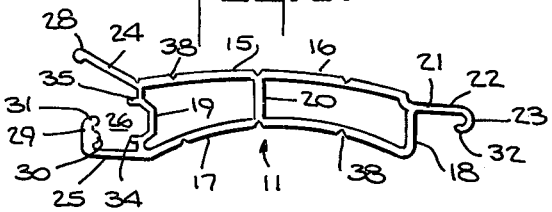
FIG. 3 is a cross section of an extruded slat prior to the bending step.

Consequently, the extrusion die for this embodiment has a shape conforming to that shown in FIG. 3, which shows the cross section of the extrusion as it emerges from the die. The shape in the "as extruded" condition is identical to the desired final shape, except that the front member 24 is angled forward from its final position, by about 30°, to create an opening 27' such that the corresponding thickness of the die is sufficient to prevent breakage at this point under the pressure required for extruding aluminum.

With reference to FIG. 6, an extrusion die for producing simultaneously two extrusions having the cross-sectional shape of FIG. 3 is machined from a steel disc 40 adapted to fit into a stepped die cavity cup 41 of a conventional aluminum extrusion press. Depending on the dimensions of the slat relative to the dimensions of the press, the die can be made to produce more than two extrusions at a time, or only one extrusion.

It should be noted that solid portions 42, 43 of the extrusion die, which create the internally partitioned hollow body of the extrusion, must be made as inserts separate from the die disc 40. This is a conventional technique well known to those skilled in the art of extrusion die construction, and it does not form part of the present invention.

Figure 4:
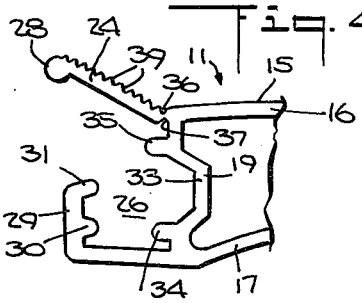
FIG. 4 is an enlarged view of the slotted edge portion of the slat of FIG. 3.

After extrusion in the form shown in FIG. 3 (and in detail in FIG. 4), the front member 24 extrusion is bent rearwardly to the final position shown in FIG. 5 by using a conventional roller apparatus, as illustrated semi-schematically in FIG. 7. Bending can be facilitated by providing small notches 36 and 37 at the junction of front member 24 with the body of the slat, to serve as a natural hinge line.

With reference to FIG. 7, the rolling operation is accomplished by leading the slotted edge of an extrusion through the gap between a pair of rollers 44 and 45. The gap between the rollers is adjustable (by means not shown), and they are rotated in the directions shown by the arrows 46 and 47 by a conventional drive means 48. Such roller devices are conventional equipment in an extrusion shop and do not need to be further described here.

As the rollers turn, the extrusion 11 feeds through in the direction of arrow 49, thereby causing the outwardly angled front member 24 to be bent into its final desired position.

Following the bending operation, which leaves the extrusion in its final form, the extrusion can be heat treated to appropriate hardness and strength. Finally, it is desirable to anodize or otherwise coat the finished extrusion to protect against corrosion and to provide an attractive color for the finished slat. The appearance of the slat can also be enhanced by spaced shallow grooves 38 on the front and rear walls of the body and serrations 39 on the face of front member 24, if desired. The serrations 39 provide the additional advantage of preventing the roller from marking or scratching the surface of the extrusion during the bending operation.

As mentioned above, the invention also includes a method of assembling extruded slats into a shutter. As a first step, slats of the desired length, depending on the width of the window or door into which the shutter is to be fitted, are cut from the finished extrusions, which may be up to 60 feet in length as they come from the extrusion press but will usually be cut into standard lengths (e.g., 18 to 20 feet) before heat treatment and surface finishing.

With reference to FIG. 8, a transverse slot 50, spaced slightly from each end of each slat, is cut through the head and stem portion of the hook-like first member 21, and a similar slot 51 is cut through the front and rear members 24 and 25, thereby forming tabs 52, 53, and 54 of the remainders of the first, front and rear members, respectively, between the slots 50 and 51 and the adjacent end of the slat. The tabs 52 at each end of each slot are then removed, either by cutting or preferably by simply bending the tab with pliers. This operation is easily accomplished because the aluminum after heat treatment is relatively brittle, so that tab 52 will fracture easily at the hinge line defined by grooves 36, 37.

Two slots are next assembled by sliding the first member 21 of one slat into the undercut slot 26 of the other slat until the ends of the slats are in alignment. The two slats are then locked against sliding apart simply by crimping together the tabs 53 and 54 at each end of the other slat to close the gap 27 (see FIG. 5) between them. This operation is repeated until the number of slats needed to provide a shutter of desired height are assembled.

From the foregoing descrption of the preferred embodiment, it is clear that the method of the present invention provides in a simple and inexpensive manner a strong, lightweight, and attractive extruded aluminum slat for a roller shutter, while avoiding any problem of extrusion die breakage, and permits rapid assembly and locking of slats into a completed shutter, with the only tool required being a pair of pliers.

I claim:

1. A method of manufacturing an extruded aluminum slat for a roller shutter, the slat having a first member extending from a first edge and formed, in cross section, with a stem portion and a head portion, the head portion having greater transverse outer dimension then the stem portion, and front and rear members extending in spaced apart relation from the opposite edge, the rear member having a turned hook-like edge and forming in conjunction with the front member an undercut slot having an opening adapted to loosely receive a stem portion of a first member of another slat but too narrow to permit passage of the head portion of such first member, wherein the method comprises:

extruding aluminum through a die conforming to the desired final cross-sectional shape of the slat except that the opening of the die corresponding to the front member is angled away from the opening of the die corresponding to the rear member, so that said front member is extruded in spread apart relation to said rear member, thereby permitting the part of the die corresponding to the opening of the undercut slot to be strong enough to withstand the aluminum extruding pressure, and bending said front member toward said rear member after the extruding step to obtain the desired final opening dimension therebetween, the cross-sectional shape of said front member having a reduced thickness where the front portion joins said opposite edge, said reduced thickness serving as a hinge to facilitate said bending step.

2. A method of manufacturing an extruded aluminum slat for a roller shutter, the slat including a first hook portion extending from one edge, a second hook portion extending from the opposite edge such that the second hook portion is adapted to engage the first hook portion of another of said slats to provide an articulated connection therebetween, and a wall portion extending from said opposite edge of the slat in closely spaced relation to the second hook portion to slidably hold a first hook portion of another slat in interlocking engagement with said second hook portion, wherein said method comprising in sequence:

extruding aluminum through a die to form an intermediate slat wherein said wall portion is angled away from the second hook portion, so that the part of the die corresponding to the gap between the second hook portion and the wall portion can be thick to prevent fracture of said part by the pressure required to extrude the aluminum slat and bending said wall portion of the intermediate slat toward the second hook portion to form a final slat, the cross-sectional shape of said wall portion having a reduced thickness where the wall portion joins said opposite edge portion, said reduced thickness portion serving as a hinge to facilitate said bending step.

3. A method of manufacturing an extruded aluminum slat for a roller shutter, the slat including a hollow body portion having a front wall, a rear wall spaced from the front wall, and first and second edge walls joining the front and rear walls, a first hook portion extending from the first edge wall, a second hook portion extending from the second edge wall such that the second hook portion is adapted to engage the first hook portion of another slat to provide an articulated connection therebetween, and a wall portion extending from the second edge wall in spaced relation to the second hook portion toward the free edge of said second hook portion, wherein said method comprises:

extruding aluminum through a die to form a hollow elongated shape having said front wall, rear wall, first edge wall, second edge wall, first hook portion, and second hook portion in the identical shape and location desired for the finished slat and a wall portion having a cross-sectional shape identical to that desired for the wall portion of the finished slat, said wall portion extending from the second edge portion in a direction such that there is a large enough gap between the free end of said wall portion and the free end of the second hook portion to avoid breaking the extrusion die at the part corresponding to said gap, and bending said wall portion of the extruded slat into a final desired position in which there is a small gap between the free end of said wall portion and the free end of the second hook portion, said small gap being only wide enough to slidably accommodate the first hook portion without permitting the first hook portion to be disengaged through said gap, and the cross-sectional shape of said wall portion having a reduced thickness where the wall portion joins the second edge portion, said reduced thickness portion serving as a hinge to facilitate said bending step.

4. A method of manufacturing an extruded aluminum slat according to claim 3 wherein the step of bending said wall portion comprises applying a roller against the face of said wall portion.

5. A method of manufacturing an extruded aluminum slat according to claim 4 wherein the face of the wall portion is formed with closely spaced serrations in the path of the roller, to prevent the roller from marking the surface of the slat during the bending step.

* * * * *

UNITED STATES PATENT AND TRADEMARK OFFICE

CERTIFICATE OF CORRECTION

PATENT NO. : 4,428,218

DATED : January 31, 1984

INVENTOR(S) : Joseph M. LaRocca

It is certified that error appears in the above-identified patent and that said Letters Patent is hereby corrected as shown below:

In the title, change "SALT" to --SLAT--.

Signed and Sealed this

*First* Day of *May 1984*

[SEAL]

*Attest:*

GERALD J. MOSSINGHOFF

*Attesting Officer*

*Commissioner of Patents and Trademarks*